United States Patent [19]

Erdman

[11] Patent Number: 4,713,190

[45] Date of Patent: Dec. 15, 1987

[54] MODIFIED CARBOXYLIC AMIDE DISPERSANTS

[75] Inventor: Timothy R. Erdman, San Rafael, Calif.

[73] Assignee: Chevron Research Company, San Francisco, Calif.

[21] Appl. No.: 790,578

[22] Filed: Oct. 23, 1985

[51] Int. Cl.[4] ..... C10M 131/12; C10M 133/56

[52] U.S. Cl. ..... 252/51.5 A; 252/32.5; 252/49.6; 252/49.9; 252/51.5 R; 252/58; 564/9; 564/12

[58] Field of Search ..... 252/51, 51.5 A, 51.5 R, 252/58, 49.9, 49.6, 32.5; 564/9, 12

[56] References Cited

U.S. PATENT DOCUMENTS

| | | | |
|---|---|---|---|
| 3,183,244 | 5/1965 | Fein | 564/9 X |
| 3,284,409 | 11/1966 | Dorer | 252/49.6 X |
| 3,338,832 | 8/1967 | LeSuer | 252/49.6 X |
| 3,422,017 | 1/1969 | Dadura et al. | 252/49.9 |
| 3,435,043 | 3/1969 | Brokke et al. | 564/12 X |
| 3,502,677 | 3/1970 | LeSuer | 260/268 |
| 3,507,918 | 4/1970 | Dadura et al. | 252/49.9 X |
| 3,562,160 | 2/1971 | Ford et al. | 252/49.9 |
| 3,609,077 | 9/1971 | Breitigam | 252/32.5 |
| 3,649,659 | 3/1972 | Otto et al. | 260/429 R |
| 4,016,092 | 4/1977 | Andress | 252/32.5 |
| 4,025,445 | 5/1977 | Hellmuth et al. | 564/9 X |
| 4,118,330 | 10/1978 | Hotten | 252/49.9 X |
| 4,119,552 | 10/1978 | Davis et al. | 252/49.6 |
| 4,338,205 | 7/1982 | Wisotsky | 252/32.5 |
| 4,358,509 | 11/1982 | Rysek | 428/461 |
| 4,379,064 | 4/1983 | Cengel et al. | 252/51.5 A |

OTHER PUBLICATIONS

Hackh's Chemical Dictionary, 4th Ed., 1969, p. 25.

*Primary Examiner*—William R. Dixon, Jr.
*Assistant Examiner*—Ellen M. McAvoy
*Attorney, Agent, or Firm*—S. R. LaPaglia; R. C. Gaffney; G. F. Swiss

[57] ABSTRACT

Carboxylic amide dispersants are reacted with a fluorine-containing acid reagent selected from fluorophosphoric acid, boron trifluoride, fluoboric acid and the ammonium salts thereof. The reaction of the dispersant with the fluorine-containing acid passivates the dispersant to fluorocarbon compositions used as seals, for example in automobile engines.

14 Claims, No Drawings

MODIFIED CARBOXYLIC AMIDE DISPERSANTS

FIELD OF THE INVENTION

This invention relates to modified carboxylic amide dispersants which have a reduced tendency to attack fluorohydrocarbon-type engine seals, and lubricating oil compositions containing said dispersants.

More particularly, this invention relates to products prepared from carboxylic amides containing basic nitrogen groups and a fluorine-containing acid selected from the group consisting of fluorophosphoric acid, boron trifluoride, fluoboric acid and the ammonium salts or complexes thereof, and to lubricating oils containing said adducts.

BACKGROUND OF THE INVENTION

Fluorocarbon elastomers are commonly used in assembling internal combustion engines. The seals are used to prevent leakage of lubricants at the point where moving parts, such as the crankshaft, leaves the engine.

It is well known that the fluorocarbon elastomers are subject to attack by basic amine compounds which are usually present in lubricating oil compositions. This attack consists of base-promoted dehydrofluorination and cross-linking of the elastomer leading to, in essence, further curing of the material. This attack by the dispersants causes a loss of both elasticity and tensile strength in the elastomer. The seal eventually deteriorates to a point to where it fails to adequately prevent leakage of the lubricant from the crankcase.

U.S. Pat. No. 3,422,017 discloses load carrying oil additives which are the reaction product of primary, secondary or tertiary monoamines containing up to 30 carbon atoms and fluorophosphoric acid.

U.S. Pat. No. 4,379,064 teaches a method of mild oxidation of basically reacting polyamine crankcase dispersants in order to passivate the dispersant to fluorocarbon compositions used in engines.

U.S. Pat. No. 3,502,677 discloses additives for lubricating oil compositions which are the reaction product of an alkenyl succinimide and a phosphorus acid-producing compound. Suitable phosphorus acid-producing compounds disclosed in this reference include, among others, phosphoric acids, phosphorus acids, phosphonyl acids, phosphinyl acids and the halides thereof.

It has now been discovered that carboxylic amide dispersants containing basic nitrogen groups may be passivated to fluorocarbon elastomers used in engines by reacting said dispersants with a fluorine-containing acid selected from the group consisting of fluorophosphoric acid, boron trifluoride, fluoboric acid and the ammonium salts or complexes thereof.

The passivation of these dispersants is accomplished by reducing the total base of the dispersant by 50% to 90% of its original value.

SUMMARY OF THE INVENTION

The present invention is directed toward a lubricating oil additive which is prepared by reacting a carboxylic amide dispersant which contains basic nitrogen groups and a fluorine-containing acid selected from the group consisting of fluorophosphoric acid, boron trifluoride, fluoboric acid and the ammonium salts or complexes thereof.

More particularly, this invention is directed to a hydrocarbon-soluble reaction product of:

(a) a carboxylic amide dispersant which contains at least one basic nitrogen group; and (b) a fluorine-containing acid selected from the group consisting of fluorophosphoric acid, boron trifluoride, fluoboric acid and the ammonium salts or complexes thereof wherein the amount of said fluorine-containing acid is from about 0.1 to 1 equivalent per equivalent of basic nitrogen atom. Another embodiment of this invention is directed to lubricating oil compositions comprising an oil of lubricating viscosity and effective dispersancy providing amount of said product.

DETAILED DESCRIPTION OF THE INVENTION

Lubricating oil compositions containing the additive prepared as disclosed herein, provides dispersancy to the oil while at the same time does not cause deterioration of fluorocarbon engine seals and the associated leak of lubricant from the crankcase. It has further been found that lubricating oil compositions containing the products of this invention enhance the wear protection provided by the lubricating compositions.

The precise molecular formula of the products of this invention is not known with certainty; however, they are believed to be compounds in which the fluorine-containing acid is either complexed by or as the salt of one or more nitrogen atoms of the basic nitrogen-containing carboxylic amides used in the preparation of these compositions.

The fluorophosphoric acids employed in the formation of the compounds of the present invention are prepared by the general methods described on pages 779 to 786 of Volume 10 of the *Encyclopedia of Chemical Technology* by R. E. Kirk and Orthmer, published by The Interscience Encyclopedia, Inc., New York, N.Y., 1980.

Boron trifluoride and fluoboric acid are commercially available reagents.

Fluorophosphoric acids and fluoboric acid form ammonium salts by simple addition of ammonia to these acids. On the other hand, boron trifluoride forms an ammonium complex when combined with ammonia.

The carboxylic amide starting materials of this invention must have a basic nitrogen content as measured by ASTM D-664 or D-2896. It is preferably oil-soluble. These basic nitrogen-containing carboxylic amides are described below (keeping in mind the reservation that each must have at least one basic nitrogen).

Carboxylic amide compositions suitable as starting materials for preparing the products of this invention are known in the art. Typical of such compounds are those disclosed in U.S. Pat. No. 3,405,064, the disclosure of which is hereby incorporated by reference. These compositions are ordinarily prepared by reacting a carboxylic acid, or anhydride ester thereof, having at least 12 to about 350 aliphatic carbon atoms in the principal aliphatic chain and, if desired, having pendent aliphatic groups to render the molecule oil soluble, with an amine or a hydrocarbyl polyamine, such as an ethylene amine, to give a mono or polycarboxylic acid amide. Preferred are those amides prepared from (1) a carboxylic acid of the formula $R^2COOH$, where $R^2$ is $C_{12-20}$ alkyl or a mixture of this acid with a polyisobutenyl carboxylic acid or diacid in which the polyisobutenyl group contains from 22 to 128 carbon atoms, and (2) a polyamine.

Among the polyamines suitable for preparing carboxylic amides, particularly preferred polyamines are alkylene polyamines having the formula:

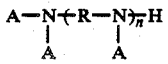

wherein n is an integer between 1 and about 10, preferably, between 2 and 8; each A can be independently hydrogen, hydrocarbyl, or hydroxy-substituted hydrocarbyl which can be derived from an alkylene oxide compound, having up to about 30 atoms; and R is a divalent hydrocarbon radical having from about 1 to about 6 carbons. A can be an aliphatic radical of up to about 10 carbon atoms which may be substituted with one or two hydroxy groups, and R is a lower alkylene radical having 1–10, preferably 2–6 carbon atoms. Preferred polyamines are the alkylene polyamines wherein each A is hydrogen. Such alkylene polyamines include methylene polyamines, ethylene polyamines, butylene polyamines, propylene polyamines, pentylene polyamines, hexylene polyamines and heptylene polyamines. The higher homologs of such amines and related aminoalkyl-substituted piperazines are also included. Specific examples of such polyamines include ethylene diamine, triethylene tetramine, tris(2-aminoethyl)amine, propylene diamine, trimethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, 2-heptyl-3-(2-aminopropyl)-imidazoline, 1,3-bis-(2-aminoethyl)imidazoline, 1-(2-aminopropyl)-piperazine, 1,4-bis(2-aminoethyl)-piperazine and 2-methyl-1(2-aminobutyl)-piperazine. Higher homologs, obtained by condensing two or more of the above-illustrated alkylene amines, are also useful, as are the polyoxyalkylene polyamines (e.g., "Jeffamines").

The ethylene polyamines, examples of which are mentioned above, are especially useful for reasons of cost and effectiveness. Such polyamines are described in detail under the heading "Diamines and Higher Amines" in Kirk-Othmer, *Encyclopedia of Chemical Technology*, Second Edition, Vol. 7, pp. 22–39. They are prepared most conveniently by the reaction of an alkylene chloride with ammonia or by reaction of an ethylene imine with a ring-opening reagent such as ammonia. These reactions result in the production of the somewhat complex mixtures of alkylene polyamine, including cyclic condensation products such as piperazines. Because of their availability, these mixtures are particularly useful in preparing the nitrogen-bridged dispersant. Satisfactory products can also be obtained by the use of pure alkylene polyamines.

Hydroxy polyamines, e.g., alkylene polyamines having one or more hydroxyalkyl substituents which can be derived from the alkylene oxide on the nitrogen atoms, are also useful in preparing the nitrogen-bridged dispersant. Preferred hydroxyalkyl-substituted alkylene polyamines are those in which the hydroxyalkyl group has less than about 10 carbon atoms. Examples of such hydroxyalkyl-substituted polyamines include N-(2-hydroxyethyl)ethylene diamine, N,N'-bis(2-hydroxyethyl)-ethylene diamine, 1-(2-hydroxyethyl)piperazone, monohydroxypropyl-substituted diethylene triamine, dihydroxypropyltetraethylene pentamine and N-(3-hydroxybutyl)tetramethylene diamine. Higher homologs obtained by condensation of the above-illustrated hydroxyalkyl-substituted alkylene amines through amino radicals or through hydroxy radicals are likewise useful.

In the reaction mixture, the ratio of the fluorine-containing acid selected from fluorophosphoric acid, boron trifluoride, fluoboric acid and ammonium salts or complexes thereof to basic nitrogen compound is in the range of from 0.1 to 1 equivalent of acid (or the ammonium salt or complex thereof) per equivalent of basic nitrogen compound. Preferably, from 0.4 to 1.0, and most preferably from 0.4 to 0.7, equivalents per equivalent of basic nitrogen is added to the reaction mixture.

The products of this invention are prepared by reacting the fluorine-containing acid and the carboxylic amide at a temperature sufficient to cause reaction. The reaction is conducted either neat or in the presence of a suitable inert diluent such as toluene, 325 thinner, which is a mixture of aromatics, naphthenes and paraffins, and the like. Suitable reaction temperatures are from 0° C. to 250° C. although preferably 20° C. to 150° C. The reaction is generally completed in about 0.1 to 10 hours and may be purified by conventional techniques.

The lubricating oil compositions containing the additives of this invention can be prepared by admixing, by conventional techniques, the appropriate amount of the adduct with a lubricating oil. The selection of the particular base oil depends on the contemplated application of the lubricant and the presence of other additives. Generally, the amount of the additive will vary from 0.1 to 15% by weight and preferably from 0.2 to 10% by weight.

The lubricating oil which may be used in this invention includes a wide variety of hydrocarbon oils, such as naphthenic bases, paraffin bases and mixed base oils as well as synthetic oils such as esters and the like. The lubricating oils may be used individually or in combination and generally have a viscosity which ranges from 50 to 5,000 SUS and usually from 100 to 15,000 SUS at 38° C.

In many instances it may be advantageous to form concentrates of the additive within a carrier liquid. These concentrates provide a convenient method of handling and transporting the additives before their subsequent dilution and use. The concentration of the additive within the concentrate may vary from 15 to 85% by weight although it is preferred to maintain a concentration between 15 and 50% by weight. While the preferred use of the additives and compositions of this invention is in the crankcase of internal combustion engines, the final application of the lubricating oil compositions of this invention may be in marine cylinder lubricants as in cross-head diesel engines, crankcase lubricants as in railroads, lubricants for heavy machinery such as steel mills and the like, or as greases for bearings and the like and in transmission fluids. Whether the lubricant is fluid or a solid will ordinarily depend on whether a thickening agent is present. Typical thickening agents include polyurea acetates, lithium stearate and the like.

Another contemplated use for the lubricating oil compositions of this invention is in two-cycle engines. In this environment, the lubricating oil composition containing the additives of this invention are added to the fuel.

If desired, other additives may be included in the lubricating oil compositions of this invention. These additives include antioxidants or oxidation inhibitors, dispersants, rust inhibitors, anti-corrosion agents and so forth. Also anti-foam agents stabilizers, anti-stain agents, tackiness agents, anti-chatter agents, dropping point improvers, anti-squawk agents, extreme pressure agents and the like may be included.

The invention is further illustrated by, but not limited to, the following examples.

EXAMPLES

Example 1

To a 1-liter reaction flask was added 500 g of an amide dispersant composition prepared from an aliphatic carboxylic acid of approximately 280 molecular weight and tetraethylenepentamine (where the ratio of carboxylic acid to polyamine is approximately 3 to 1). The mixture was warmed to 60° C. and 64 g $BF_3$.etherate was added over a period of 48 minutes. The reaction was then heated to 150° C. for 3 hours to give a product which contained 5.71% N, 1.10% B, and 4.72% F.

Example 2

To a 1-liter reaction flask was added 350 g of the amide dispersant of Example 1 and 200 ml of Chevron Thinner 325 which is a mixture of aromatics, naphthenes and paraffins. The mixture was warmed to 50° C. and 79 g of an aqueous solution of $HBF_4$ (48%) was added over a period of 16 minutes. The reaction was heated to 200° C. for 1 hour while removing water and solvent overhead. The product was then filtered and stripped to give a material containing 5.76% N, 1.58% B, and 8.19% F.

Example 3

To a 500 ml flask was added 111 g of the amide dispersant of Example 1 and 50 ml of Chevron Thinner 325. The mixture was heated to 60° C. and a solution of 20.9 g $HPF_6$ (70% based on P) in 11 ml conc. $NH_4OH$+25 ml water was added over a period of 15 minutes. The reaction mixture was heated to 200° C. for 30 minutes while removing water and solvent overhead. The product contained 5.77% N, 2.56% P, and 8.56% F.

Example 4

To a 1-liter reaction flask was added 500 g of an amide dispersant prepared by reacting 0.6 moles of a polyisobutylene succinic anhydride of about 1100 molecular weight and 1.8 moles of an aliphatic carboxylic acid of about 280 molecular weight with 1.0 moles of tetraethylenepentamine. The mixture was warmed to 60° C. and 64 g $BF_3$.etherate was added over a period of 48 minutes. The reaction was heated to 150° C. for 3 hours to give a product containing 3.50% N, 1.11% B, and 4.63% F.

Example 5

To a 1-liter reaction flask was added 350 g of the amide dispersant of Example 4 and 200 ml of Chevron Thinner 325. The mixture was warmed to 50° C. and 77 g aqueous $HBF_4$ solution (48%) was added over a period of 17 minutes. The reaction was then heated to 200° C. for 1 hour while removing water and solvent overhead. The product was filtered and stripped to give a material containing 3.53% N, 1.49% B, and 7.90% F.

Example 6

To a 500 ml reaction flask was added 94.4 g of the amide dispersant of Example 4 and 100 ml toluene. The mixture was warmed to 95° C. and a solution of 20.9 g $HPF_6$ (70% based on P) in 11 ml conc. $NH_4OH$+20 ml water was added over a period of 20 minutes. The reaction mixture was heated to 150° C. while removing water and solvent overhead. The product was then filtered and stripped to 150° C. and 5 mm Hg to give a material containing 3.50% N, 2.68% P, and 10.04% F.

Example 7

Several of the compounds of this invention were tested for their anti-wear properties in an ASTM D-2670 Falex wear procedure modified in the following regards. The tests were run at 500 lb (227 kg) for 30 minutes (compared to 250 lb for 15 minutes as called for in ASTM D-2690 procedure) and shaft weight losses recorded. In all cases, lower weight loss indicates superior results. Likewise, failure in this test is either weight loss of greater than 20 mg or shaft breakage.

The test is conducted in a base oil, RPM 480 Neutral, formulated with only the test additive. The results of this test are reported in Table I below:

TABLE I

Falex Wear Test (Modified ASTM D-2670) Conducted With 3% Test Additive in RPM 480 Neutral Base Oil

| Additive | Shaft Weight Loss (mg) |
|---|---|
| Untreated amide dispersant of Example 1 | Failure in 1 minute |
| Product of Example 1 | 4.0 |
| Product of Example 2 | 2.5 |
| Product of Example 3 | 1.7 |
| Untreated amide dispersant of Example 4 | Failure in 1 minute |
| Product of Example 4 | 6.5 |
| Product of Example 5 | 2.6 |
| Product of Example 6 | 2.4 |

What is claimed is:

1. A hydrocarbon-soluble product produced by the process which comprises reacting at a temperature sufficient to cause reaction:
   (a) a carboxylic amide containing at least one basic nitrogen wherein said carboxylic amide is derived from an aliphatic carboxylic acid containing 12 to 350 aliphatic carbon atoms; and
   (b) a fluorine-containing acid selected from the group consisting of fluorophosphoric acid, boron trifluoride, fluoboric acid and the ammonium salts or complexes thereof wherein the amount of said flourine-containing acid is from about 0.1 to 1 equivalent per equivalent of basic nitrogen atom.

2. The hydrocarbon-soluble product of claim 1 wherein the fluorine-containing acid is fluorophosphoric acid.

3. The hydrocarbon soluble product of claim 2 wherein the fluorophosphoric acid is selected from the group consisting of monofluorophosphoric acid, difluorophosphoric acid, hexafluorophosphoric acid and the ammonium salts thereof.

4. The hydrocarbon-soluble product of claim 1 wherein the carboxylic amide is derived from a $C_{12-20}$ carboxylic acid.

5. The hydrocarbon-soluble product of claim 1 wherein the carboxylic amide is prepared by reacting a polyamine with a mixture of a $C_{12-20}$ carboxylic acid and a polyisobutenyl carboxylic acid or diacid in which the polyisobutenyl group contains 22 to 128 carbon atoms.

6. The hydrocarbon-soluble product of claim 5 wherein the polyamine is an alkylene polyamine.

7. A lubricating oil composition comprising an oil of lubricating viscosity and a dispersant effective amount of the product of claim 1.

8. A lubricating oil concentrate comprising from 85 to 15% by weight of an oil of lubricating viscosity and from 15 to 85% by weight of the product of claim 1.

9. A method for passivating a carboxylic amide dispersant containing at least one basic nitrogen to fluorocarbon elastomers which comprises reacting at a temperature sufficient to cause reaction:

(a) a carboxylic amide dispersant containing at least one basic nitrogen wherein said carboxylic amide is derived from an aliphatic carboxylic acid containing 12 to 350 aliphatic carbon atoms; and (b) a fluorine-containing acid selected from the group consisting of fluorophosphoric acid, boron trifluoride, fluoboric acid and ammonium salts or complexes thereof wherein the amount of said fluorine-containing acid is from about 0.1 to 1 equivalent per equivalent of basic nitrogen atom.

10. The method of claim 9 wherein the fluorine-containing acid is fluorophosphoric acid.

11. The method of claim 10 wherein the fluorophosphoric acid is selected from the group consisting of monofluorophosphoric acid, difluorophosphoric acid, hexafluorophosphoric acid and the ammonium salts thereof.

12. The method of claim 9 wherein the carboxylic amide is derived from a $C_{12-20}$ carboxylic acid.

13. The method of claim 9 wherein the carboxylic amide is dispersant is prepared by reacting a polyamine with a mixture of a $C_{12-20}$ carboxylic acid and a polyisobutenyl carboxylic acid or diacid in which the polyisobutenyl carboxylic acid or diacid in which the polyisobutenyl group contains from 22 to 128 carbon atoms.

14. The method of claim 13 wherein the polyamine is an alkylene polyamine.

* * * * *